US008315402B2

(12) United States Patent
Zhang et al.

(10) Patent No.: US 8,315,402 B2
(45) Date of Patent: Nov. 20, 2012

(54) METHOD AND APPARATUS FOR REAL-EAR MEASUREMENTS FOR RECEIVER-IN-CANAL DEVICES

(75) Inventors: Tao Zhang, Eden Prairie, MN (US); Thomas Spaulding, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 694 days.

(21) Appl. No.: 12/414,889

(22) Filed: Mar. 31, 2009

(65) Prior Publication Data

US 2009/0245525 A1 Oct. 1, 2009

Related U.S. Application Data

(60) Provisional application No. 61/041,034, filed on Mar. 31, 2008.

(51) Int. Cl.
*H04R 29/00* (2006.01)
*H04R 25/00* (2006.01)

(52) U.S. Cl. ..... 381/60; 381/322; 381/328; 381/330

(58) Field of Classification Search ..... 381/58, 381/60, 71.6, 72, 312, 322, 324, 328, 330; 181/130, 135; 600/559; 607/55
See application file for complete search history.

(56) References Cited

U.S. PATENT DOCUMENTS

| | | | |
|---|---|---|---|
| 3,491,214 | A | 1/1970 | Rosemond et al. |
| 4,564,955 | A | 1/1986 | Birch et al. |
| 4,809,708 | A | 3/1989 | Geisler et al. |
| 5,386,475 | A | 1/1995 | Birck et al. |
| 5,711,308 | A | 1/1998 | Singer |
| 5,792,073 | A | 8/1998 | Keefe |
| 5,897,494 | A | 4/1999 | Flock et al. |
| 5,987,146 | A | 11/1999 | Pluvinage et al. |
| 6,007,494 | A | 12/1999 | Zenner et al. |
| D431,294 | S | 9/2000 | Barnard et al. |
| 6,154,546 | A | 11/2000 | Uvacek |
| 6,674,862 | B1 | 1/2004 | Magilen |
| D506,258 | S | 6/2005 | Nielsen |
| 7,239,711 | B1 | 7/2007 | Andersen et al. |
| 7,599,508 | B1 | 10/2009 | Lynch et al. |
| 7,756,283 | B2 | 7/2010 | Bramslow |

(Continued)

FOREIGN PATENT DOCUMENTS

| | | | |
|---|---|---|---|
| AU | 5830898 | A | 9/1998 |

(Continued)

OTHER PUBLICATIONS

"Australian Application Serial No. 2009201227, Response filed Apr. 18, 2011 to First Examiner Report mailed Apr. 20, 2010", 9 pgs.

(Continued)

*Primary Examiner* — Matthew W Such
*Assistant Examiner* — Scott Stowe
(74) *Attorney, Agent, or Firm* — Schwegman, Lundberg & Woessner, P.A.

(57) ABSTRACT

The present subject matter provides method and apparatus for real ear measurement using a hearing assistance device fitted with a cover to provide real ear sounds to a microphone of the device. The present subject matter includes a hearing assistance device cover for use in measuring coupler response and real ear coupler difference for improved real ear measurement and fitting.

23 Claims, 5 Drawing Sheets

U.S. PATENT DOCUMENTS

| | | | | |
|---|---|---|---|---|
| 7,778,424 | B2 | 8/2010 | Lange | |
| 8,059,847 | B2 | 11/2011 | Nordahn | |
| 2002/0085729 | A1 | 7/2002 | Marx | |
| 2004/0028250 | A1 | 2/2004 | Shim | |
| 2004/0044389 | A1 | 3/2004 | Crawford | |
| 2004/0234094 | A1 | 11/2004 | Saunders et al. | |
| 2005/0002539 | A1 | 1/2005 | Nielsen | |
| 2006/0045282 | A1 * | 3/2006 | Reber | 381/60 |
| 2006/0171550 | A1 | 8/2006 | Bryant et al. | |
| 2007/0009107 | A1 | 1/2007 | Lange | |
| 2007/0217639 | A1 | 9/2007 | Stirnemann | |
| 2008/0152178 | A1 | 6/2008 | Topholm et al. | |
| 2008/0194984 | A1 | 8/2008 | Keefe | |
| 2008/0260192 | A1 | 10/2008 | Yanz et al. | |
| 2008/0260193 | A1 | 10/2008 | Westermann et al. | |
| 2008/0298600 | A1 | 12/2008 | Poe et al. | |
| 2009/0245560 | A1 | 10/2009 | Zhang et al. | |
| 2009/0299215 | A1 | 12/2009 | Zhang | |
| 2010/0202642 | A1 | 8/2010 | LoPresti et al. | |
| 2010/0246869 | A1 | 9/2010 | Zhang et al. | |
| 2010/0260343 | A1 | 10/2010 | Recker et al. | |
| 2011/0098551 | A1 | 4/2011 | Zhang | |

FOREIGN PATENT DOCUMENTS

| | | | |
|---|---|---|---|
| AU | 2010200103 | B2 | 7/2011 |
| AU | 2010201189 | | 9/2011 |
| AU | 2009201227 | B2 | 10/2011 |
| AU | 2009201228 | B2 | 1/2012 |
| DE | 4327634 | C1 | 6/1994 |
| EP | 0381608 | A2 | 8/1990 |
| EP | 1448014 | B1 | 10/2005 |
| EP | 1705950 | A2 | 9/2006 |
| EP | 2107831 | A2 | 10/2009 |
| WO | WO-8901315 | A1 | 2/1989 |
| WO | WO-9931936 | A1 | 6/1999 |
| WO | WO-0239784 | A1 | 5/2002 |
| WO | WO-2005089016 | A1 | 9/2005 |
| WO | WO-2007045254 | A1 | 4/2007 |
| WO | WO-2007045271 | A1 | 4/2007 |
| WO | WO-2010016925 | A1 | 2/2010 |

OTHER PUBLICATIONS

"European Application Serial No. 09250957.9, Extended European Search Report mailed Dec. 13, 2010", 5 pgs.
"European Application Serial No. 09250957.9, Response filed Jul. 5, 2011 to Extended European Search Report mailed Dec. 13, 2010", 16 pgs.
"Australian Application Serial No. 2009201227, First Examiner Report mailed Apr. 20, 2010", 2 Pgs.
Yanz, Jerry, et al., "Real Ear Measurement System Using Thin Tube", U.S. Appl. No. 60/912,343, filed Apr. 17, 2007, 19 pgs .
"U.S. Appl. No. 12/102,602, Non Final Office Action mailed Apr. 4, 2012", 7 pgs.
"U.S. Appl. No. 12/102,602, Response filed to Restriction Requirement mailed Dec. 8, 2011", 8 pgs.
"U.S. Appl. No. 12/102,602, Restriction Requirement mailed Nov. 8, 2011", 6 pgs.
"U.S. Appl. No. 12/130,764, Non-Final Office Action mailed Aug. 20, 2010", 8 pgs.
"U.S. Appl. No. 12/130,764, Preliminary Amendment mailed Jul. 21, 2008", 6 pgs.
"U.S. Appl. No. 12/130,764, Response filed Jul. 30, 2010 to Restriction Requirement mailed Jul. 29, 2010", 7 Pgs.
"U.S. Appl. No. 12/130,764, Restriction Requirement mailed Jul. 29, 2010", 9 pgs.
"U.S. Appl. No. 12/414,876, Non Final Office Action mailed Aug. 12, 2011", 8 pgs.
"U.S. Appl. No. 12/414,876, Notice of Allowance mailed Jan. 11, 2012", 5 pgs.
"U.S. Appl. No. 12/414,876, Response filed Dec. 12, 2011 to Non Final Office Action mailed Aug. 8, 2011", 9 pgs.
"U.S. Appl. No. 12/537,908 , Response filed Jan. 11, 2012 to Non Final Office Action mailed Oct. 11, 2011", 9 pgs.
"U.S. Appl. No. 12/537,908, Final Office Action mailed Mar. 15, 2012", 11 pgs.
"U.S. Appl. No. 12/537,908, Non Final Office Action mailed Oct. 11, 2011", 10 pgs.
"U.S. Appl. No. 12/537,908, Preliminary Amendment mailed Jun. 22, 2010", 3 pgs.
"U.S. Appl. No. 12/685,295, Non Final Office Action mailed Mar. 12, 2012", 7 pgs.
"U.S. Appl. No. 12/730,380, Non Final Office Action mailed Mar. 30, 2012", 10 pgs.
"U.S. Appl. No. 12/980,745, Preliminary Amendment mailed Feb. 14, 2011", 5 pgs.
"Australian Application Serial No. 2009201228, First Examiner Report mailed Apr. 23, 2010", 1 pg.
"Australian Application Serial No. 2009201228, Office Action Response Filed Aug. 3, 2011", 5 pgs.
"Australian Application Serial No. 2010200103, First Examiner Report mailed Feb. 2, 2011", 2 pgs.
"Australian Application Serial No. 2010200103, Response filed Jul. 8, 2011 to First Examiner Report mailed Feb. 2, 2011", 5 pgs.
"Australian Application Serial No. 2010201189, Examiner Report mailed Mar. 11, 2011", 1 pg.
"Australian Application Serial No. 2010201189, Response filed May 19, 2011 to Examiner Report mailed Mar. 11, 2011", 1 pg.
"Australian Application Serial No. 2009201228, Subsequent Examiner Report mailed Jun. 23, 2011", 2 pgs.
"Australian Application Serial No. 2009280002, Office Action Mailed Mar. 23, 2012", 2 Pgs.
"European Application Serial No. 08251441.5, Extended Search Report mailed Dec. 20, 2011", 18 pgs.
"European Application Serial No. 09250958.7, Extended European Search Report mailed Nov. 29, 2010", 5 pgs.
"European Application Serial No. 09250958.7, Response filed Jun. 24, 2011 to Extended European Search Report mailed Nov. 29, 2010", 5 pgs.
"European Application Serial No. 10250039.4, Extended Search Report mailed Apr. 16, 2012", 8 pgs.
"European Application Serial No. 10250568.2, Extended Search Report mailed Dec. 13, 2011", 8 pgs.
"European Application Serial No. 10250568.2, Office Action mailed Jan. 16, 2012", 2 pgs.
"European Application Serial No.08251441.5, Partial European Search Report mailed Jul. 14, 2011", 5 pgs.
"International Application Serial No. PCT/US2009/004528, International Preliminary Report on Patentability mailed Feb. 17, 2011", 6 pgs.
"International Application Serial No. PCT/US2009/004528, Search Report mailed Oct. 13, 2009", 7 pgs.
"International Application U.S. Appl. No. PCT/US2009/004528, Written Opinion mailed Oct. 13, 2009", 7 pgs.
Chan, C K, et al., "Estimation of Eardrum Acoustic Pressure and of Ear Canal Length From Remote Points in the Canal Length From Remote Points in the Canal", Journal of the Acoustical Society of America, vol. 87, No. 3, XP009035813 ISSN: 0001-4966, (Mar. 1, 1990), 1237-1247.
Dillon,PH.D., Harvey, "Hearing Aids", 4.4 Practical Issues in Real-Ear Testing, (Jan. 1, 2001), 101-104.
Hudde, H, et al., "Methods for Estimating the sound pressure at the eardrum", Journal of the Acoustical Society of America, vol. 106, No. 4, XP012001248 ISSN: 0001-4966, (Oct. 1, 2009), 1977-1992.
Moodie, K Shane, et al., "Procedure for Predicting Real-Ear Hearing Aid Performance in Young Children", Am. Journal of Audiology, Am. Speech-Language-Hearing Association, 3(1), (Mar. 1, 1994), 23-31.
Munro, Kevin J, et al., "Measuring the Real-Ear to Coupler Difference Transfer Function with and Insert Earphone and a Hearing Instrument: Are they the same?", Ear and Hearing, 26(1), (Feb. 1, 2005), 27-34.
Pascal, Jerome, et al., "Linear and nonlinear model of the human middle ear", J. Acoust. Soc. Am., vol. 104, No. 3, Pt. 1, (Sep. 1998), 1509-1516.

* cited by examiner

METHOD AND APPARATUS FOR REAL-EAR MEASUREMENTS FOR RECEIVER-IN-CANAL DEVICES

RELATED APPLICATIONS

The present application claims the benefit under 35 U.S.C. 119(e) of U.S. Provisional Patent Application Ser. No. 61/041,034 filed on Mar. 31, 2008, which is incorporated herein by reference in its entirety.

FIELD OF THE INVENTION

The present subject matter relates to hearing assistance devices and in particular to method and apparatus for real ear measurement for receiver-in-canal hearing assistance devices.

BACKGROUND

Hearing assistance devices are used to improve hearing for wearers. Such devices include, but are not limited to, hearing aids. Real ear measurement attempts to measure the actual sound produced by the hearing assistance device in an ear canal of a wearer of the device. Without real ear measurements, the fitting software of the hearing assistance device estimates the sound pressure level in the ear canal based on average ear geometry. This may be highly inaccurate.

What is needed in the art is an integrated system for real ear measurement. The system for real ear measurement should be available for use with various hearing assistance devices, such as hearing aids.

SUMMARY

The present subject matter provides method and apparatus for real ear measurement using a hearing assistance device fitted with a cover to measure the real ear sounds using a microphone of the device. One embodiment provides a method for using a hearing assistance device including a receiver adapted to be positioned in an ear canal of a user, the method comprising placing a cover on the hearing assistance device, the cover including a tube adapted for an acoustically sealed connection to a microphone of the hearing assistance device, playing sound using the receiver, recording sound using the microphone, and adjusting one or more settings of the hearing assistance device using the recorded sounds and a real ear coupler difference (RECD).

One embodiment provides a cover for a hearing assistance device comprising a retention mechanism to attach the cover to the hearing assistance device, a first aperture configured to approximately align with a microphone port of a hearing assistance device when the cover is placed on the hearing assistance device, a second aperture to connect to a sound tube, and an acoustic channel connecting the first aperture to the second aperture, wherein the cover is adapted to acoustically seal at least a portion of a microphone of the hearing assistance device.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1A:
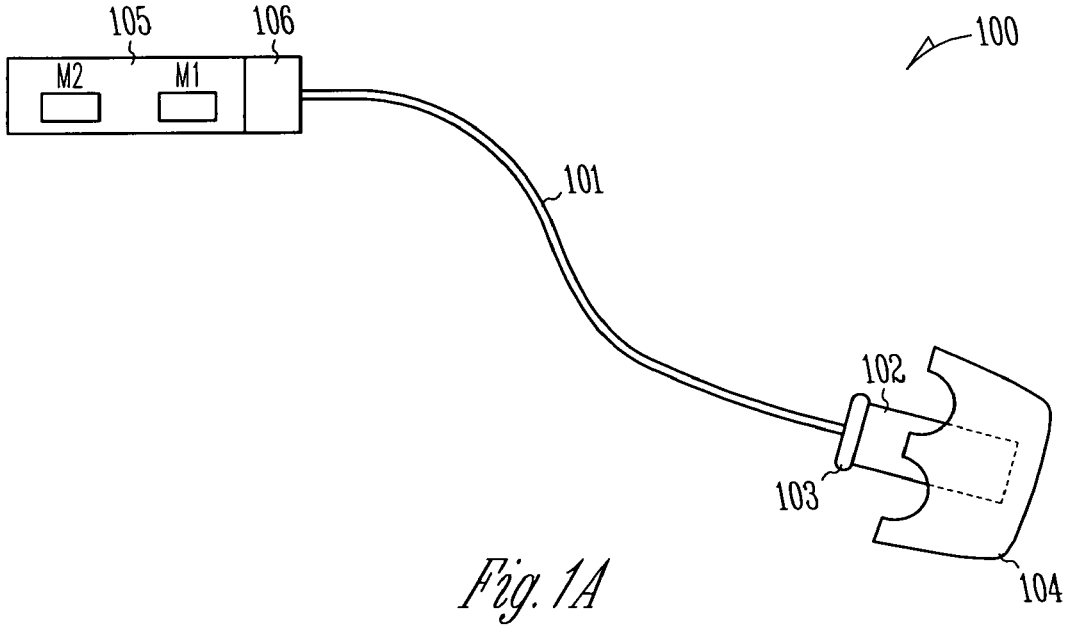
FIG. 1A is an example of a receiver-in-canal (RIC) hearing assistance device in one application of the present subject matter.

FIG. 1A is an example of a receiver-in-canal (RIC) hearing assistance device in one application of the present subject matter. RIC hearing assistance devices ("RIC devices") include RIC hearing aids. RIC devices 100 include a receiver or speaker 102 adapted to be situated in or about the wearer's ear canal with wires 101 leading from the receiver 102 to a unit behind or over the ear 105. In some embodiments, connectors may be used such as those set forth in FIG. 1A as connectors 103 and 106. Examples of some connectors may be found in U.S. patent application Ser. No. 11/857,439, entitled: System for Hearing Assistance Device Including Receiver in the Canal, filed Sep. 19, 2007, the specification of which is hereby incorporated by reference in its entirety. Such RIC devices 100 may employ ear pieces 104 that are standard ear buds or custom ear molds that can be open or vented designs. Such behind or over the ear units 105 may include one or more microphones. The example in FIG. 1A shows a first microphone M1 and a second microphone M2 as one possible combination of microphones. The microphone or microphones may be directional or omnidirectional or switchable.

Figure 1B:
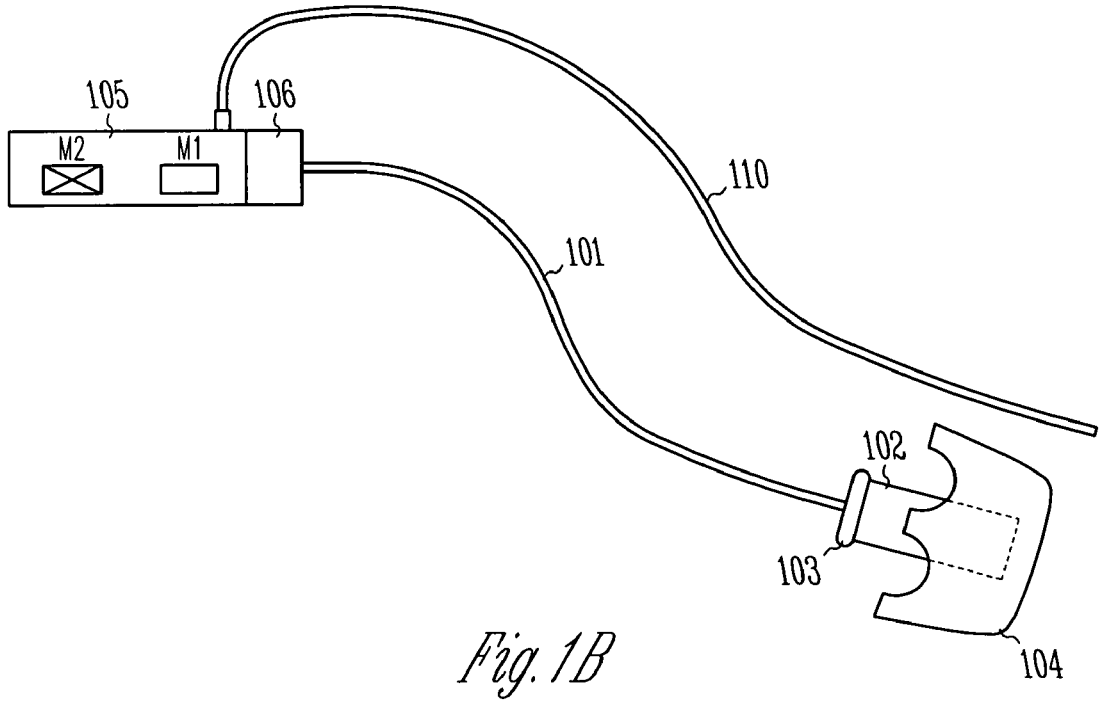
FIG. 1B is a drawing showing how sound is routed back to a behind-the-ear portion of the RIC device for real ear measurement, according to one embodiment of the present subject matter.

Real ear measurements are used to measure and record the sound delivered to the ear drum of the wearer for better fitting of the device to the wearer. Real ear measurements are also used for more complete understanding of the sounds played to the wearer and for diagnosing issues with the device and the device's settings. FIG. 1B is a drawing showing how sound is routed back to a behind-the-ear portion of the RIC device for real ear measurement, according to one embodiment of the present subject matter. Sound tube 110 is placed in the wearer's ear canal and is used to sample sounds emitted from receiver 102 during a real ear measurement. The sound is routed to microphone M1 using the sound tube 110 in this example, and microphone M2 is covered up to prevent sound reception from ambient noise (demonstrated as an "x" over microphone M2). It is understood that several different configurations and measurements may be made and that those demonstrated herein are not intended to be exclusive or limiting. Details of how the sound can be routed are demonstrated by the following description. In the examples set forth herein, a removable cover attaches to the behind or over the ear portion. The cover is replaced with a special cover designed to facilitate real ear measurements. Other method and apparatus for performing real ear measurements are possible without departing from the scope of the present subject matter.

Figure 2:
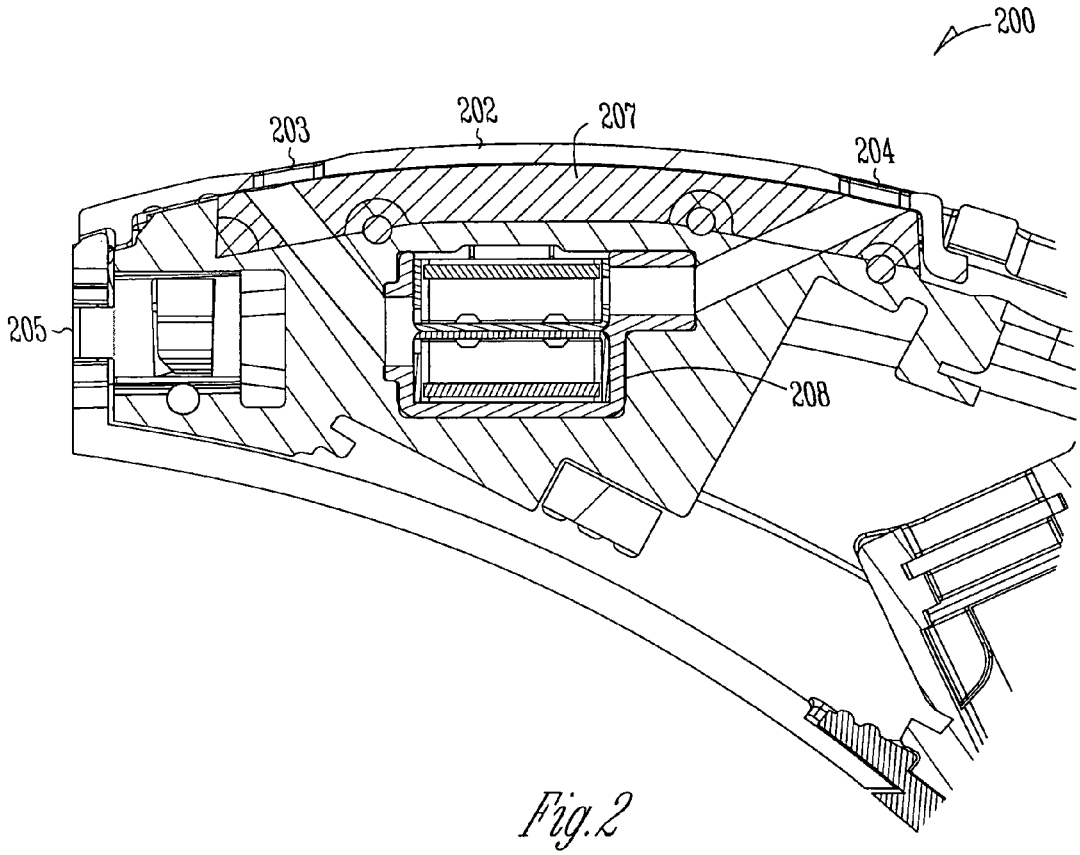
FIG. 2 is an example of a cross section drawing of a behind-the-ear portion of a RIC hearing assistance device configured for normal operation.

FIG. 2 is an example of a cross section drawing of a behind-the-ear portion of a RIC hearing assistance device configured for normal operation. The term "normal operation" is used for operation where the hearing assistance device is not in its real ear measurement mode of operation. In the example of FIG. 2, the behind-the-ear portion 200 includes a cover 202 that defines front microphone port 203 and rear microphone port 204. Microphone ports 203 and 204 provide apertures for sound to reach microphone assembly 208. Underneath cover 202 is a pliable material 207, such as silicone rubber, which conforms to provide an acoustic seal with cover 202. Cover 202 can be made of any material which will provide a durable cover with good acoustic sealing properties, such as plastic or other rigid material. Port 205 provides connections for the RIC cable (not shown) that leads to the RIC receiver (not shown).

Figure 3:
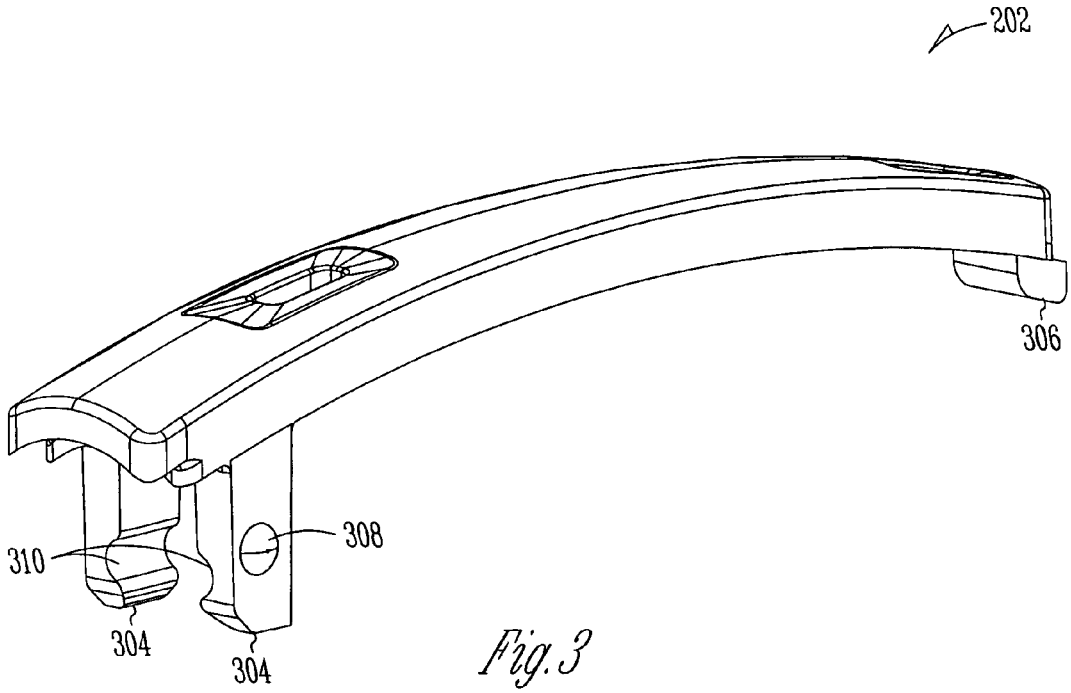
FIG. 3 is an example of a perspective drawing of a cover used for the behind-the-ear portion of the RIC device of FIG. 2, which is used in normal operation.

FIG. 3 is an example of a perspective drawing of a cover used for the behind-the-ear portion of the RIC device of FIG. 2, which is used in normal operation. The retention mechanisms for cover 202 include locking legs 304 and a locking lip 306. Locking legs can include bumps, indents, teeth or other retention mechanisms. Locking legs 304 include such as bumps 308 and indents 310 to maintain sufficient pressure to fix the cover to the body of the behind-the-ear unit. It is desirable to maintain a tight fit of the cover to avoid acoustic leakage which can foster acoustic feedback or other problems. Other forms of retention mechanisms may be used, without departing from the scope of the present subject matter.

Figure 4:
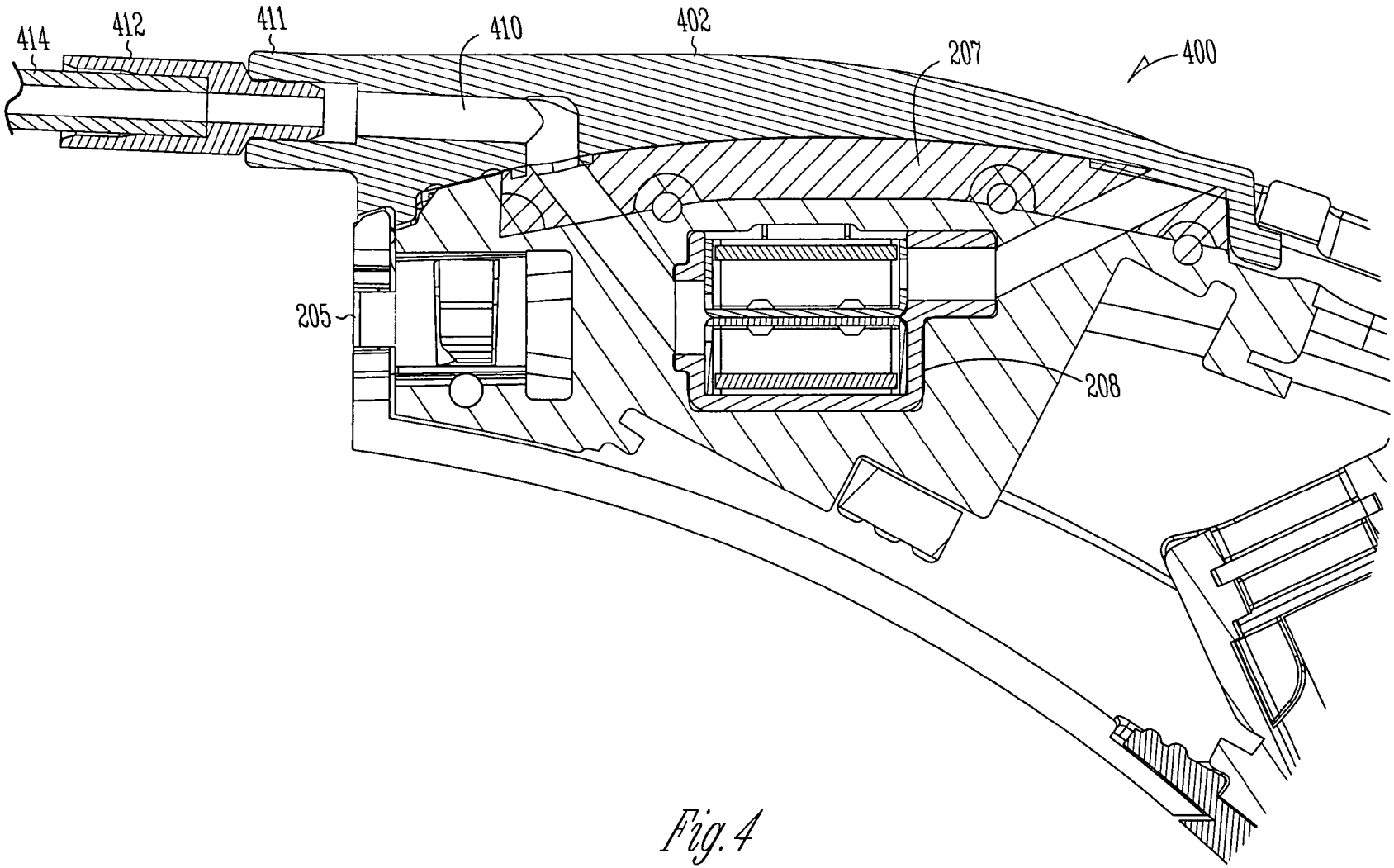
FIG. 4 is an example of a cross section drawing of a behind-the-ear portion of the RIC hearing assistance device configured for real ear measurement, according to one embodiment of the present subject matter.

FIG. 4 is an example of a cross section drawing of a behind-the-ear portion of the RIC hearing assistance device configured for real ear measurement, according to one embodiment of the present subject matter. The device 400 is configured for real ear measurement by removal of cover 202 and placement of cover 402 over pliable seal 207. In this example the rear microphone port of microphone assembly 208 is covered. The front port of microphone assembly 208 receives sound from acoustic channel 410 which is connected to connector 412 and thus real ear measurement tube 414. In one embodiment, connector 412 provides an acoustically tight fit between real ear sound tube 414 and cover 402 using a pliable rubber that is a friction fit to port 411 to avoid leaks. Cover 402 can be made of any material which will provide a durable cover with good acoustic sealing properties, such as plastic or other rigid material. Thus, cover 402 provides for real ear measurement using the front microphone and covers the rear sound port. It is understood that cover 402 could also be configured to provide sound to the rear microphone port and cover the front microphone port, or to provide sound to both microphone ports. Some materials and dimensions of sound tubes and connectors include, but are not limited to those that are found in U.S. Provisional Patent Application Ser. No. 60/912,343, filed Apr. 17, 2007, entitled: REAL EAR MEASUREMENT SYSTEM USING THIN TUBE, the entire specification of which is hereby incorporated by reference. Thus, variations design and use may occur without departing from the scope of the present subject matter.

Figure 5A:
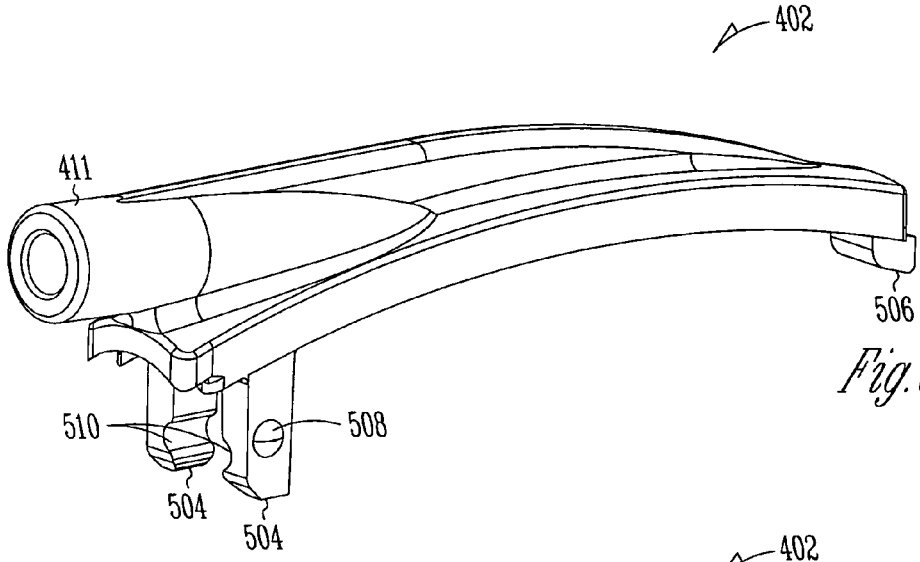
FIGS. 5A-5C are examples of perspective drawings of a cover used for the behind-the-ear portion of the RIC device of FIG. 4, which is used for real ear measurement, according to one embodiment of the present subject matter.
Figure 5B:
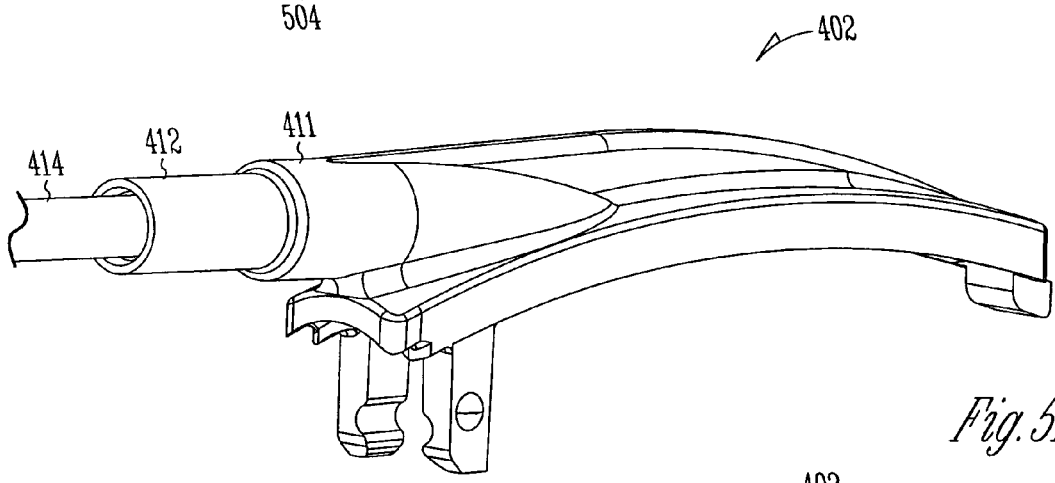
Figure 5C:
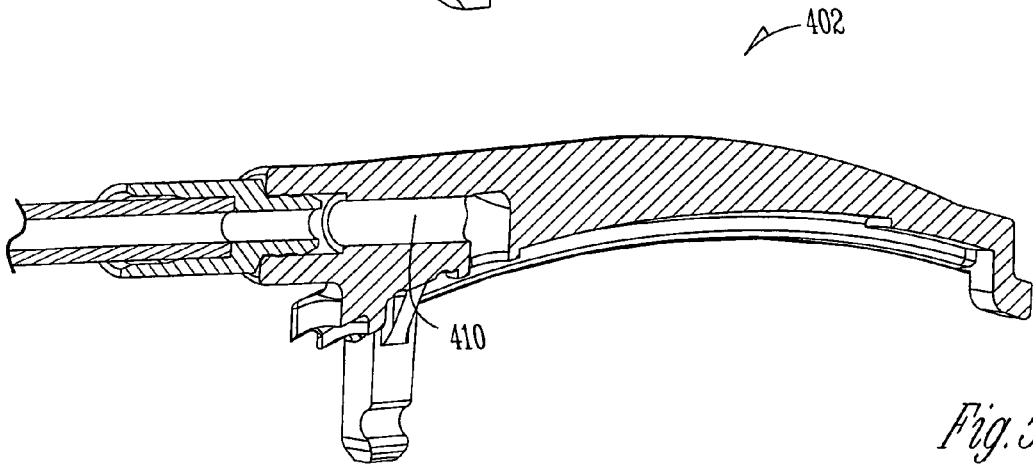

FIGS. 5A-5C are examples of perspective drawings of a cover used for the behind-the-ear portion of the RIC device of FIG. 4, which is used for real ear measurement, according to one embodiment of the present subject matter. As shown in FIG. 5A, the retention mechanisms for cover 402 generally are the same as those used for cover 202 to maintain sufficient pressure to fix the cover to the body of the behind-the-ear unit. It is desirable to maintain a tight fit of the cover to avoid acoustic leakage which can foster acoustic feedback or other problems. In the example of FIG. 5A, recesses 510 and bumps 508 of locking legs 504 are shaped substantially the same as for cover 202 to provide a quick replacement of covers. Other forms of retention mechanisms may be used, without departing from the scope of the present subject matter. FIG. 5B shows the tube 414, connector 412 and port 411 and FIG. 5C shows a cutaway drawing where acoustic channel 410 is visible. Variations in design and acoustic channel routing are possible without departing from the scope of the present subject matter. Different materials may be used provided that a good acoustic seal is made with the pliable layer of the behind or over the ear unit.

One way to perform real ear measurement is to provide a way to get sound played in the ear canal back to a microphone on the device. This can be performed in a variety of ways, including, but not limited to, using a sound tube in the ear canal to route sound back to a microphone on the behind-the-ear or over-the-ear microphone. Since many hearing assistance devices include multiple microphones it is also beneficial to include a way to block sounds to any microphones that are not in use in order to isolate received sound to a single microphone and to eliminate unwanted room noise or other interferences during the real ear measurement. One way to perform this is to mechanically block any unwanted sounds by the use of an acoustical shield or cover.

Figure 6:
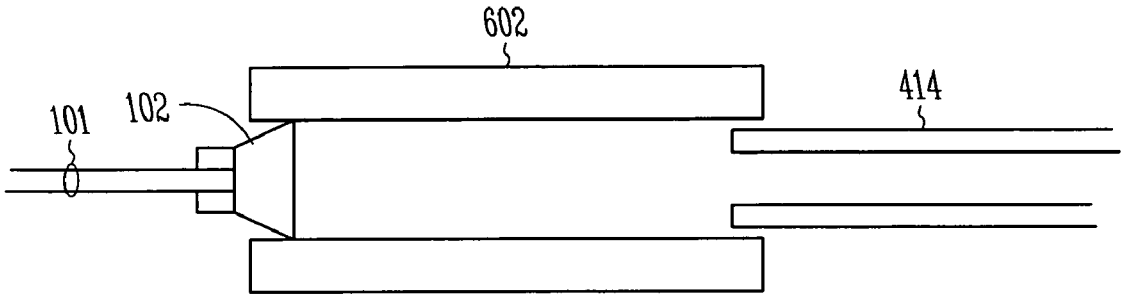
FIG. 6 is an example of a coupler used to make measurements according to one embodiment of the present subject matter.

In one embodiment of the present subject matter, real ear measurement (REM) is performed by first making a coupler response measurement and then following that with a real ear coupler difference measurement or RECD. Once an RECD is obtained it can be used in fitting to provide the audiologist accurate information as to the actual sound in the wearer's ear canal during fitting. Before doing a REM, a coupler response measurement is performed at the factory or audiologist's office. In one embodiment, the coupler response is generated as follows: Real ear measurement cover 402 is placed on the over or behind the ear unit and real ear tube 414 is connected to port 411. A coupler response is calculated by connecting a coupler 602 to the RIC receiver 102 and then the other side of the coupler is connected to the sound tube for the real ear measurement 414, as shown in FIG. 6. Sound is played by the receiver 102 using programming of the hearing assistance device and measured at the sound tube 414 and microphone of the hearing assistance device to which it is coupled. The measured sound is subtracted from the sound that was played to get the coupler response. Thus, Coupler Response=microphone response using sound tube in the coupler minus the sound played.

In one embodiment, sound is played at 0-8 KHz at 100 Hz intervals, creating an 80 point matrix. However, this is just one example. Other intervals and ranges are possible without departing from the scope of the present subject matter.

A real ear coupler difference measurement (RECD) is performed by replacing the normal operation cover 202 with the real ear measurement cover 402, inserting the real ear microphone tube connector 412 of tube 414 into the port 411 of the real ear measurement cover 402, placing the other end of the real ear microphone tube inside any opening of an open ear mold/ear bud (or alongside a closed ear mold) so as to avoid bending the tube, playing sound into the wearer's ear canal using the receiver-in-the-ear while recording sound received by the real ear microphone tube using the microphone on the behind or over the ear device, and generating the real ear coupler difference (RECD) by the equation:

RECD=Real-ear response minus the Coupler Response.

Where the Real-ear response is given by:

Real-ear response=microphone response using sound tube in the real-ear minus the sound played.

In one embodiment, sound is played at 0-8 KHz at 100 Hz intervals, creating an 80 point matrix. However, this is just one example. Other intervals and ranges are possible without departing from the scope of the present subject matter.

When performing a real ear measurement, the real ear cover is installed to seal any unused microphone ports (e.g., seal the rear microphone port if the front microphone is being used to record real ear sounds and the directional device utilizes a static directional module). The real ear measurement microphone (e.g., front microphone) is coupled to the real ear measurement tube using an acoustic seal, and bending of the tube is minimized to avoid changing the response of the tube.

In normal operation all of the microphones are coupled to their respective sound ports using an acoustic seal. In some embodiments the hearing assistance device includes default receiver assembly information stored on the device, microphone calibration information, and nominal coupler response information. The coupler response for each device can be obtained by combining the microphone calibration and the nominal coupler response. In some embodiments, an indicator is included to indicate that a calibration has been performed.

When the hearing assistance device is first used with a default receiver assembly in the field, the following occur according to one embodiment: the default receiver matrix is used in the fitting software, the coupler response remains the same in some embodiments; and REM is performed such that the firmware uses the default REM stimulus. The stimulus is constructed to achieve similar signal-to-noise ratios across frequencies. The stimulus level is chosen to provide sufficient signal-to-noise ratio, but is still within the linear range of the receiver. The stimulus duration is chosen so that random interferences during the measurement can be reduced to a sufficient level via time-domain averaging. Default quality control values are used with the REM response to accept valid measurements, reject invalid measurements due to improper placement of the sound tube, improper coupling between the sound tube and the microphone, a pinched or blocked sound tube. The RECD is calculated as the REM response minus the stored coupler response, and the fitting is adjusted using the measured RECD.

If the receiver is replaced in the field, fitting is performed using the following steps, according to one embodiment: the user selects the proper receiver matrix in the fitting software. If the new receiver has the same matrix as the previous receiver, the fitting will be the same as the prior fitting. If the new receiver has a different matrix than the prior receiver, then in one approach the existing RECD values in the nonvolatile memory, if any, are cleared. The firmware then adjusts the REM stimulus to maintain a sufficient signal to noise ratio in the REM across a range of frequencies. The stimulus level is adjusted to provide sufficient signal-to-noise ratio, but is still within the linear range of the receiver. The stimulus duration is chosen so that random interferences during the measurement can be reduced to a sufficient level via time-domain averaging. The coupler response will be adjusted in the nonvolatile memory of the hearing assistance device using the new receiver matrix information. New quality control values can be used with the REM response to, accept valid measurements, reject invalid measurements due to improper placement of the sound tube, improper coupling between the sound tube and the microphone, a pinched or blocked sound tube, a new RECD is generated from the REM response minus the adjusted coupler response, and fitting is adjusted using the new RECD and matrix information.

It is understood that different fitting systems and processes including different steps, order of steps, and apparatus can be derived from the present teachings that remain within the scope of the present subject matter. Processes for enhancing the real ear measurement data include, but are not limited to those fitting processes included in U.S. Provisional Patent Application Ser. No. 60/912,343, filed Apr. 17, 2007, entitled: REAL EAR MEASUREMENT SYSTEM USING THIN TUBE, the entire specification of which is hereby incorporated by reference.

It is understood one of skill in the art, upon reading and understanding the present application will appreciate that variations of order, information or connections are possible without departing from the present teachings. This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A method for using a hearing assistance device including a receiver adapted to be positioned in an ear canal of a user, the method comprising:

placing a cover on the hearing assistance device, the cover including a tube port adapted for connection to a sound tube for measurement of sound and a retention mechanism to fix the cover to the hearing assistance device, the retention mechanism including a locking lip at a first end of the cover and one or more locking legs at a second end of the cover;

placing the receiver in the ear canal;

playing sound using the receiver;

recording sound using the tube; and adjusting one or more settings of the hearing assistance device by processing the recorded sounds.

2. The method of claim 1, wherein placing a cover includes acoustically blocking a second microphone opening of the hearing assistance device.

3. The method of claim 1, wherein processing includes processing the recorded sounds using a real ear coupler difference (RECD).

4. The method of claim 1, further comprising positioning an end of the sound tube proximal the receiver in the ear canal.

5. The method of claim 1, further comprising inserting an end of the sound tube through an opening of an ear bud holding the receiver in the ear canal.

6. The method of claim 1, wherein placing the real ear measurement cover includes removing a first cover.

7. The method of claim 1, further comprising generating a real ear coupler difference (RECD) using the recorded sound.

8. The method of claim 1, wherein playing sound includes playing a plurality of sounds having a frequency between 0 and 8000 hertz.

9. The method of claim 8, wherein the frequency of each sound of the plurality of sounds is separated in frequency by about 100 hertz.

10. The method of claim 1, wherein playing sound includes adjusting the sound within a linear range of the receiver to provide a substantially equal signal-to-noise ratio across a range of sound frequencies.

11. A system for real ear measurement comprising:

a hearing assistance device adapted for placement of a receiver in a ear canal of a user; and a cover, the cover including:

a retention mechanism to attach the cover to the hearing assistance device, the retention mechanism including a locking lip at a first end of the cover;

a first aperture configured to approximately align with a microphone port of the hearing assistance device when the cover is placed on the hearing assistance device;

a second aperture to connect to a sound tube; and an acoustic channel connecting the first aperture to the second aperture.

12. The system of claim 11, wherein the retention mechanism includes one or more locking legs at a second end of the cover.

13. The cover of claim 11, further comprising the sound tube coupled to the second aperture.

14. The system of claim 13, wherein the sound tube comprises a pliable rubber portion.

15. The system of claim 11, wherein the cover is adapted to block a second microphone port of the hearing assistance device.

16. The system of claim 11, wherein the cover is plastic.

17. The system of claim 11, wherein the cover is rigid.

18. A cover for a hearing assistance device, comprising:

a first end;

a second end;

a retention mechanism to attach the cover to the hearing assistance device, the retention mechanism including a locking lip at the first end and one or more locking legs at the second end;

a first aperture configured to approximately align with a microphone port of a hearing assistance device when the cover is placed on the hearing assistance device;

a second aperture to connect to a sound tube; and an acoustic channel connecting the first aperture to the second aperture, wherein the cover is adapted to acoustically seal at least a portion of a microphone of the hearing assistance device.

19. The cover of claim 18 wherein the one or more locking legs comprise one or more bumps and one or more indents to maintain sufficient pressure to fix the cover to the hearing assistance device.

20. The cover of claim 18, wherein the cover is configured to replace a standard cover design.

21. A method for using a hearing assistance device including a receiver adapted to be positioned in an ear canal of a user, the method comprising:

placing a cover on the hearing assistance device, the cover including a tube port adapted for connection to a sound tube for measurement of sound;

placing the receiver in the ear canal;

playing sound using the receiver;

recording sound using the tube; and adjusting one or more settings of the hearing assistance device by processing the recorded sounds, wherein placing a cover includes acoustically blocking a second microphone opening of the hearing assistance device.

22. A method for using a hearing assistance device including a receiver adapted to be positioned in an ear canal of a user, the method comprising:

placing a cover on the hearing assistance device, the cover including a tube port adapted for connection to a sound tube for measurement of sound;

placing the receiver in the ear canal;

playing sound using the receiver;

recording sound using the tube; and adjusting one or more settings of the hearing assistance device by processing the recorded sounds wherein placing the real ear measurement cover includes removing a first cover.

23. A system for real ear measurement comprising:

a hearing assistance device adapted for placement of a receiver in a ear canal of a user; and a cover, the cover including:

a retention mechanism to attach the cover to the hearing assistance device;

a first aperture configured to approximately align with a microphone port of the hearing assistance device when the cover is placed on the hearing assistance device;

a second aperture to connect to a sound tube; and an acoustic channel connecting the first aperture to the second aperture, wherein the cover is adapted to block a second microphone port of the hearing assistance device.

* * * * *

UNITED STATES PATENT AND TRADEMARK OFFICE

CERTIFICATE OF CORRECTION

PATENT NO. : 8,315,402 B2
APPLICATION NO. : 12/414889
DATED : November 20, 2012
INVENTOR(S) : Zhang et al.

It is certified that error appears in the above-identified patent and that said Letters Patent is hereby corrected as shown below:

On The Title Page

On page 2, in column 1, under "Other Publications", line 7, delete "Pgs." and insert --pgs.--, therefor On page 2, in column 1, under "Other Publications", line 9, delete "pgs ." and insert --pgs.--, therefor On page 2, in column 1, under "Other Publications", line 18, delete "mailed" and insert --filed--, therefor On page 2, in column 1, under "Other Publications", line 21, delete "Pgs." and insert --pgs.--, therefor On page 2, in column 1, under "Other Publications", line 29, delete "Aug. 8, 2011" and insert --Aug. 12, 2011--, therefor On page 2, in column 1, under "Other Publications", line 30, delete "12/537,908 ," and insert --12/537,908,--, therefor On page 2, in column 2, under "Other Publications", line 5, delete "mailed" and insert --filed--, therefor On page 2, in column 2, under "Other Publications", line 11, delete "mailed" and insert --filed--, therefor On page 2, in column 2, under "Other Publications", line 16, delete "Filed" and insert --filed--, therefor On page 2, in column 2, under "Other Publications", line 28, delete "Mailed" and insert --mailed--, therefor Signed and Sealed this
Eighteenth Day of November, 2014

Michelle K. Lee

Michelle K. Lee
*Deputy Director of the United States Patent and Trademark Office*

On page 2, in column 2, under "Other Publications", line 28, delete "Pgs." and insert --pgs.--, therefor On page 2, in column 2, under "Other Publications", line 42, delete "No.08251441.5," and insert --No. 08251441.5,--, therefor On page 2, in column 2, under "Other Publications", line 49, delete "U.S. Appl." and insert --Serial--, therefor On page 2, in column 2, under "Other Publications", line 51, delete "C K," and insert --C. K.,--, therefor On page 2, in column 2, under "Other Publications", line 52, after "Ear Canal", delete "Length From Remote Points in the Canal", therefor On page 2, in column 2, under "Other Publications", line 56, delete "Dillon,PH.D.," and insert --Dillon, PH.D.,--, therefor On page 2, in column 2, under "Other Publications", line 58, delete "H," and insert --H.,--, therefor On page 2, in column 2, under "Other Publications", line 61, delete "K Shane," and insert --K. Shane,--, therefor On page 2, in column 2, under "Other Publications", line 65, delete "J," and insert --J.,--, therefor On page 2, in column 2, under "Other Publications", line 66, delete "and" and insert --an--, therefor